US008269648B2

(12) United States Patent
Benischek et al.

(10) Patent No.: US 8,269,648 B2
(45) Date of Patent: Sep. 18, 2012

(54) SYSTEM AND METHOD TO REMOTELY INTERACT WITH NANO DEVICES IN AN OIL WELL AND/OR WATER RESERVOIR USING ELECTROMAGNETIC TRANSMISSION

(75) Inventors: Vincent Benischek, Shrub Oak, NY (US); Michael Currie, New Hyde Park, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 519 days.

(21) Appl. No.: 12/604,310

(22) Filed: Oct. 22, 2009

(65) Prior Publication Data

US 2010/0102986 A1 Apr. 29, 2010

Related U.S. Application Data

(60) Provisional application No. 61/107,494, filed on Oct. 22, 2008.

(51) Int. Cl.
*G01V 3/00* (2006.01)

(52) U.S. Cl. ..... 340/855.8; 340/853.1

(58) Field of Classification Search ..... 340/855.8, 340/853.1, 854.6, 855.5; 166/248, 481; 343/788; 702/7; 175/50
See application file for complete search history.

(56) References Cited

U.S. PATENT DOCUMENTS

| | | | | |
|---|---|---|---|---|
| 4,140,179 | A * | 2/1979 | Kasevich et al. | 166/248 |
| 5,152,341 | A * | 10/1992 | Kasevich | 166/248 |
| 5,495,259 | A | 2/1996 | Lyasko | |
| 7,602,668 | B2 * | 10/2009 | Liang et al. | 367/25 |
| 7,631,697 | B2 * | 12/2009 | Bhavsar | 166/381 |
| 7,875,455 | B1 * | 1/2011 | Li et al. | 436/28 |
| 7,980,327 | B2 * | 7/2011 | Benischek et al. | 175/50 |
| 2010/0071894 | A1 * | 3/2010 | Benischek et al. | 166/248 |
| 2010/0073001 | A1 | 3/2010 | Benischek et al. | |

OTHER PUBLICATIONS

Federal Standard 1037C, Telecommunications: Glossary of Telecommunication Terms, Aug. 7, 1996. (http://www.its.bldrdoc.gov/fs-1037/dir-029/_4335.htm).

Forrest, D.R., Freitas Jr., RA, Jacobstein, N., "Molecular Motors, Actuators, and Mechanical Devices", Institute for Molecular Machinery White Paper, Jul. 23, 2007. (http://www.imm.org/documents/IMM_Roadmap_molecular_machines.pdf).

Lamba, Bikram, "Scientists Build World's First Single-Molecule Car", physorg.com, Oct. 20, 2005. (http://www.physorg.com/news7438.html).

"Researchers create first fully-functional nanotube radio", machineslikeus.com, Nov. 1, 2007 (http://machineslikeus.com/researchers-create-first-fully-functional-nanotube-radio.html).

* cited by examiner

*Primary Examiner* — Peguy Jean Pierre
(74) *Attorney, Agent, or Firm* — Howard IP Law Group, P.C.

(57) ABSTRACT

The invention provides for electromagnetic transmission and reception used in detecting relative changes associated with nano devices existing within an oil reservoir. The system enables monitoring of the relative movement of the nano devices in the oil and/or water over a given area based on the incremental or relative changes of the intensity of the reflections over time. In one embodiment, a source of electromagnetic energy from an array of antennae transmitting immediately in the far field recharges a power source embedded in the nano devices. In another embodiment, the return signals from the nano devices maps the morphology of ensembles of nano devices. In yet another embodiment the transmission controls the movement of the nano devices and controls the function preformed by the nano devices relative to effecting changes in the well to improve production of oil.

18 Claims, 9 Drawing Sheets

SYSTEM AND METHOD TO REMOTELY INTERACT WITH NANO DEVICES IN AN OIL WELL AND/OR WATER RESERVOIR USING ELECTROMAGNETIC TRANSMISSION

CLAIM FOR PRIORITY

This application claims priority to Provisional Patent Application Ser. No. 61/107,494 entitled SYSTEM AND METHOD TO REMOTELY INTERACT WITH NANO DEVICES IN AN OIL WELL AND/OR WATER RESERVOIR USING ELECTROMAGNETIC TRANSMISSION filed Oct. 22, 2008, the subject matter thereof incorporated by reference in its entirety.

FIELD OF THE INVENTION

This invention relates generally to subsurface fluid recovery systems, and more particularly, to a system and method that uses an array of Electromagnetic transmitters and receivers for remotely interacting with nano devices.

BACKGROUND OF THE INVENTION

The invention herein is drawn to improving the production of oil reserve recovery using communications with smart sensors, remote power delivery for smart sensor networks, reservoir imaging, monitoring and management at the oil well. An oil well is typically drilled hundreds or thousands of feet within various geological strata to reach a permeable formation containing an oil reservoir. Such permeable formations include subsurface or subterranean media through which a fluid (e.g. oil or water) may flow, including but not limited to soils, sands, shales, porous rocks and faults and channels within non-porous rocks. Various techniques are used to increase or concentrate the amount of fluid such as oil in the area of the reservoir, such area being commonly referred to as an enhanced pool.

During the initial stage of oil production, the forces of gravity and the naturally existing pressure in a reservoir cause a flow of oil to the production well. Thus, primary recovery refers to recovery of oil from a reservoir by means of the energy initially present in the reservoir at the time of discovery. Over a period of time, the natural pressure of a reservoir may decrease as oil is removed at the production well location. As the pressure differential throughout the reservoir and at the production well location decreases, the flow of oil to the well also decreases. Eventually, the flow of oil to the well will decrease to a point where the amount of oil available from the well no longer justifies the costs of production, which includes the costs of removing and transporting the oil. Many factors may contribute to diminishing flow, including the volume and pressure of the oil reservoir, the structure, permeability and ambient temperature of the formation. The viscosity of the oil, particularly the oil disposed away from the central portion of the production well, the composition of the crude oil, as well as other physical characteristics of the oil, play a significant role in decreased oil production.

As the amount of available oil decreases, it may be desirable to enhance oil recovery within an existing reservoir by external means, such as through injection of secondary energy sources such as steam or gas into the reservoir to enhance oil flow to the production well location. The effectiveness of the means used to recover the greater levels of available oil depends on knowledge of the properties and the parameters of various physical features and constituents of the particular reservoir. For example, generally little or timely information is known concerning the presence of hydrocarbons, water, location of oil/gas interfaces, or impurities such as corrosives or trace elements. When a type of hydrocarbon has been identified, generally little or timely information is known concerning pH, viscosities or fluid saturations. In addition to information on the constituents within a reservoir, it is useful to know, pressures, temperatures, stress and strain forces existing in zones of interest, permeability and porosity (pore size, pore throats, and pore geometries). Additional information useful to the recovery of oils and gas are spatial distributions of oil, water, and natural gas and locations where these constituents have been bypassed. Drilling is additionally aided when there is data on rock formation boundaries, rock layer morphology, reservoir compartments, natural fracture distributions, fault block geometries and artificial fracture geometries. Data concerning these features of wells lead to better understanding of the dynamic paths of reservoir fluids, determining how effective a particular method of extraction is working and what physical changes are occurring as the recovery process progresses.

The oil industry is researching the development of nano additives to increase oil productivity. Nano additives include interacting nanoscale structures, components, and devices. Functional nano systems are nano systems that process material, energy, or information. As nano additive systems are technologically advanced in the form of nano devices remotely rechargeable, energy sources will be required. Furthermore, remote sensing capabilities at the well site may serve to assist in the mapping of physical features such as where oil and water are migrating. Additionally, telemetry related to the acquisition of well data and data processing once the data has been obtained may be employed to analyze and report on the information useful to improving the production of gas and oil.

SUMMARY OF THE INVENTION

The invention herein relates to an oil recovery systems including a transmission and receiving system having antennae positioned and directed to transmit electromagnetic energy in the far field of an electromagnetic field through strata to irradiate nano devices situated within an oil production well.

In one aspect of the invention, the nano devices situated within an oil production well receive the transmitted electromagnetic energy to recharge a power system within the nano devices.

In another aspect of the invention, the nano devices situated within an oil production well reflect a portion of the energy from the transmissions, the reflected energy related to relative changes in the position or morphology of an ensemble of nano devices existing in a given location.

In one embodiment, a source of electromagnetic energy from an array of antennae transmitting immediately in the far field is provided for imparting pulses at the depth of the fluid reservoir. Pulses will be reflected by the nano devices within the fluid according to the reflectivity to the nano devices material and its location as it may exist in a geological framework. An array of receiver antennae may be used to initially establish a reference of the reflected pattern, and then operated in conjunction with the transmit array to monitor the movement of the nano devices in an oil and/or water within the subterranean reservoir.

In one embodiment, a source of the electromagnetic energy from an array of antennae transmitting in the far field is provided for triggering or activating nanondevices located at the depth of a fluid reservoir.

In one embodiment a source of electromagnetic energy from an array of antennae transmitting immediately in the far field is provided for imparting pulses at the depth of the fluid reservoir whereby the returns reflected by nano devices within the fluid according to the reflectivity to the nano particle or nano sensor material and its location as it may exist in a geological framework provides for mapping a 3-dimensional map and over time a 4-dimensional map of the formation (including both natural and hydraulically induced fractures).

In another embodiment, a source of electromagnetic energy from an array of antennae transmitting in the far field is provided for imparting pulses at the depth of the fluid reservoir to communicate with nano devices to effect motion of the nano devices.

In another embodiment, a source of electromagnetic energy from an array of antennae transmitting in the far field is provided for imparting pulses at the depth of the fluid reservoir to communicate with nano sensors and effect a chemical reaction using one or more of the nano devices.

A communications method for communicating information to nano sensors located within a select subsurface region: from multiple positions on or below the terrain surface and separated from the select subsurface region via geological strata, transmitting immediately in the far field electromagnetic energy beam signals of a predetermined frequency, duration, and power that combine to cover a target area of the select sub surface region; and receiving via one or more nano sensors located in an oil reservoir at the select subsurface region said electromagnetic beam signals, wherein the one or more nano sensors are responsive to the received electromagnetic beam signals to activate a function of the nano sensors. In one embodiment, the nano sensors are responsive to the received electromagnetic beam signals to recharge a battery of the nano sensors using the received electromagnetic energy signals. In another embodiment, the nano sensors are responsive to the received electromagnetic beam signals to realign themselves according to the magnetic field impinging thereon. In another embodiment, the nano sensors are responsive to the received electromagnetic beam signals to effect a chemical reaction within the oil reservoir. In another embodiment, the nano sensors are responsive to the received electromagnetic beam signals for initiating communications with other said nano sensors. In another embodiment, the nano sensors are responsive to the received electromagnetic beam signals for retrieving information from memory contained within the nano sensors and transmitting the information.

A system for communicating information to nano sensors located within a select subsurface region: a plurality of transmit antennae located at multiple positions on or below the terrain surface, the antennae adapted to transmit immediately in the far field electromagnetic energy beam signals from multiple positions on or below the terrain surface and separated from the select subsurface region via geological strata, the electromagnetic energy beam signals of a predetermined frequency, duration, and power that combine to cover a target area of the select sub surface region; and a plurality of nano sensors located in an oil reservoir at the select subsurface region and responsive to said electromagnetic beam signals to activate a function of the nano sensors. The system further comprises a plurality of receive antennae adapted to receive reflections from the target area in response to the transmitted energy beam signals impinging thereon, wherein the nano sensors are adapted to reflect or absorb the particular frequencies transmitted by the antennae such that the reflections are characteristic of the nano sensors located within the target area being impinged upon by the transmitted far field electromagnetic energy beam signals. Each of the transmit antennae comprises a compact parametric antenna having a dielectric, magnetically-active, open circuit mass core, ampere windings around said mass core, said mass core being made of magnetically active material having a capacitive electric permittivity from about 2 to about 80, an initial permeability from about 5 to about 10,000 and a particle size from about 2 to about 100 micrometers; and an electromagnetic source for driving said windings to produce an electromagnetic wavefront.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

Figure 1:
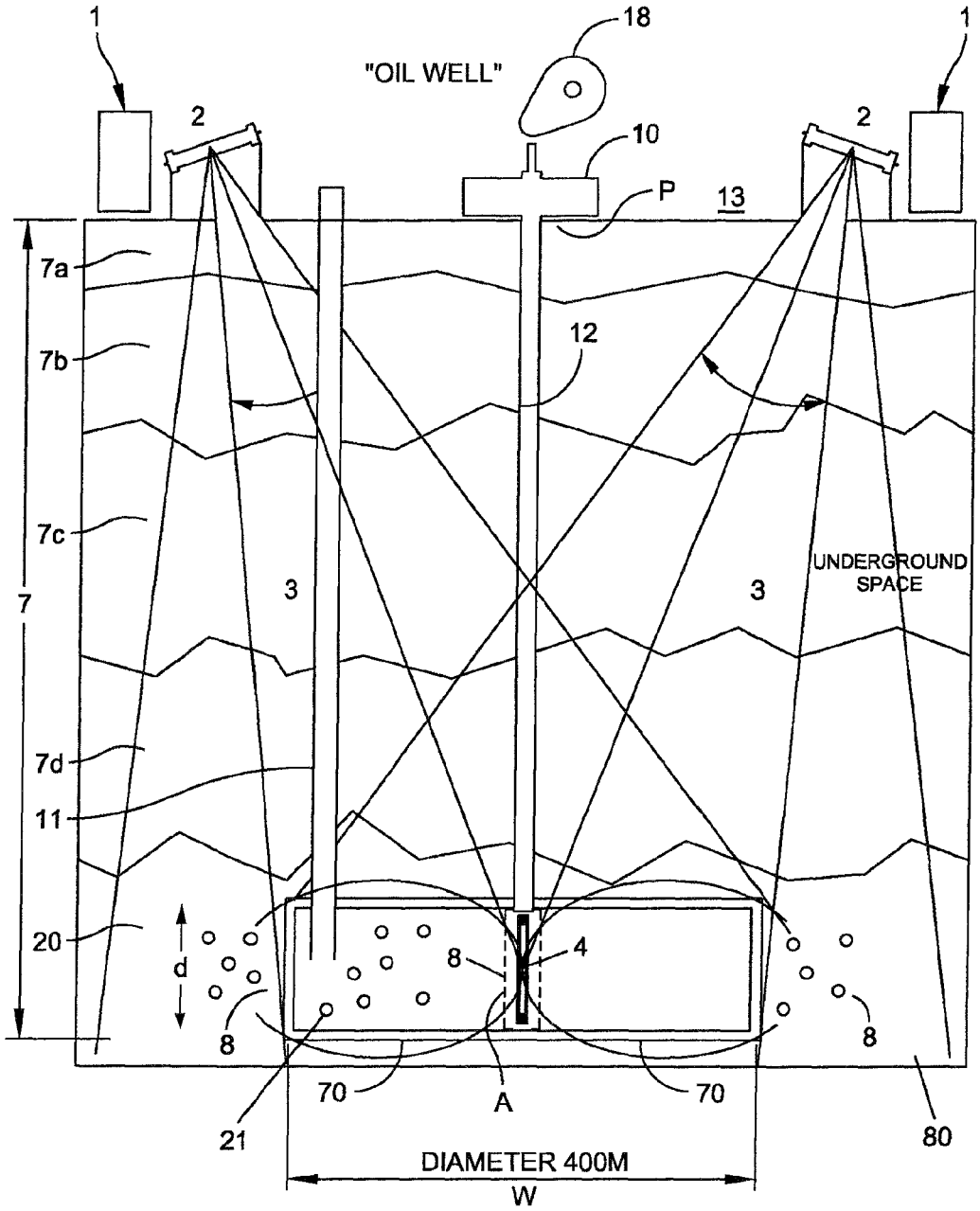
FIG. 1 is an illustration of a system for imparting electromagnetic signals into a reservoir containing oil and nano devices, according to an embodiment of the present invention.

The following description of the preferred embodiments is merely by way of example and is in no way intended to limit the invention, its applications, or uses.

The invention herein is disclosed in the context of nano technology. Nano additives refer to compositions of matter that include nano particles and/or nanosensors. Nano particles and nano sensors herein are collectively referred to as nano devices. References to nano devices include both singular, plural, ensembles, and colonies of such nano devices. Reference to nano sensor herein generally refers to a molecularly precise functional nanosystem that incorporates one or more nanoscale components that have molecularly precise structures. Note that in any application that refers to a nano device or nanosystem the application may also include active microsensor networks. Reference to passive nano devices or sensors herein generally refer to molecularly precise devices having, among other properties, mobility within the medium in which they are dispersed and reflectivity at various electromagnetic wavelengths. Furthermore, nano devices and sensors as used herein include but are not limited to categories embracing electric, magnetic, and nonelectric nano devices as well as micro and nano systems. Electric sensors include microelectromechanical systems (MEMS) and nanoelectromechanical systems (NEMS). Nonelectric sensors may also be used for constructing useful devices or performing novel functions by exploiting the unique properties of a variety of nanoscale chemistries. Nano devices are generally microscopic in scale.

The following invention is further drawn to transmitting and receiving electromagnetic, electric and/or magnetic energy, wirelessly to and from targeted nano devices used in the process of petroleum production, for purposes of: (1) powering rechargeable nano sensor power systems (e.g., voltaic cells and capacitors); (2) communicating with nano devices for purposes of gathering information such as mapping data, or sensing the physical properties and features of a petroleum environment; (3) communicating with nano sensors to effect motion of the nano sensors; (4) interrogating a nano sensor (a) computer memory to store and retrieve information or initiate a control sequence or computation, (b) to control molecular-scale analog and digital circuits; (5) to stimulate (a) a biochemical nano sensor, (b) to initiate selective chemical or catalytic processes. Nano devices may, by way of example, serve as nanosurfactants that may render something, such as a fluid, inert.

As indicated, the transmit and receive technologies employed throughout this disclosure include electromagnetic, electric, and magnetic (hereinafter collectively referred to as electromagnetic) wireless transmission and reception technologies. The transmit frequencies employed by the electromagnetic sources of energy may be in the range 100 Hz to 100 kHz.

Nano devices forming functional nanosystems include nanorobots. These nanorobots function alone or as ensembles to perform microscopic and macroscopic tasks as further outlined herein. Nanorobot swarms (large ensembles), both those which are incapable of replication and those which are capable of unconstrained replication in the environment in which they are dispersed, are also within the nano devices technology referred to herein, especially as these devices are designed to self propel, move other objects (fluids of solids) and perform work in a controlled fashion on the molecular scale. Such devices may take the form of nano-sized vehicles. By way of example, one such nano sized vehicle is referred to as the Nanocar consists of a chassis and axles made of well-defined organic groups with pivoting suspension and freely rotating axles. The molecule consists of an H-shaped chassis with fullerene groups attached at the four corners to act as wheels. The wheels are buckyballs, spheres of pure carbon containing 60 atoms apiece. The entire car measures 3-4 nanometers across.

Referring to FIG. 1, there is shown a schematic illustration of a system 1 for imparting electromagnetic signals into a permeable reservoir formation containing oil and various constituents such as surfactants to enhance oil flow according to an embodiment of the present invention. As shown in FIG. 1, a production well 10 is drilled through geological strata indicated generally as 7 such that a borehole 12 is formed. As shown, the geological strata 7 may contain multiple layers (e.g. 7*a*, 7*b*, 7*c*, 7*d*) of material, such as soil, rock, shale, sand, water, underground space, and the like. The borehole extends to a formation layer 20 defining well zones 70, 80 containing oil deposits for extraction. A filter casing such as a perforated or mesh structure supporting the borehole 12 is used in combination with a pump 18 to extract the oil contained within the reservoir. It is understood that the layer containing the oil to be recovered is volumetric and extends in both depth and width, with depth (d) illustrated along the vertical axis and a width (w) illustrated along the horizontal axis.

A problem encountered as part of the oil production process is that often there exists a rather large horizontal spread of the oil deposit within the well drainage zones 70, 80 as shown in FIG. 1. During initial drilling and oil production, the areas 4 with oil located near the casing within the reservoir are most easily extracted from the reservoir. However, as one moves away from the central location areas 4 toward zone 70 the oil may have different viscosities, the viscosity tending to be much greater than the viscosity of the oil at the central area as a function of the horizontal distance away from the areas 4. The difference in viscosity (e.g. relative increase in viscosity) of the oil away from the areas 4 of the reservoir contributes to the difficulties in harvesting such oil, resulting in an undesirable amount of oil remaining in the reservoir.

One aspect of the invention herein is directed to nano additives placed into the zones 70, 80 and areas 4 to increase oil productivity. In some instances, the nano additives may be part of a larger system where they are immersed, embedded, or statically, magnetically and/or molecularly attached to surfactants. In accordance with an embodiment of the present invention, the nano additives may be in the form of nano devices 21. As more fully described below, the nano devices may have remote rechargeable power capability, and sensing and data gathering capabilities at the well site to assist in the mapping of physical features, telemetry related to the acquisition of well data and data processing once the data has been obtained to analyze and report on the information useful to improving the production of gas and oil.

According to an embodiment of the present invention, FIG. 1 shows a compact system comprising an array of antennae 2 positioned about the production well 10 at points along the surface 13. The antennae are adapted for transmitting in the far field electromagnetic energy focused to irradiate nano devices 21 existing in individual units and as ensembles, that is large colonies of nano sensors in the well zones 70, 80 with an electromagnetic field or simply a magnetic field. In the present invention, the processing is performed such that the electromagnetic (or magnetic) energy transmitted via the antennae 2 is imparted to the nano devices 21.

The size of the nano devices 21 and ensembles or colonies of nano devices detected will be dependent upon the reflected power, signal noise and radar resolution cell (RCD), that is the volume of space that is occupied by a radar pulse and that is determined by the pulse duration and the horizontal and vertical beamwidths of the transmitting radar. Accordingly the RCD is given by RCD=150d, where the RCD is in meters and d is the pulse duration in microseconds. The height of the cell and the width of the cell will increase with range. These are given by W=(HBW)(R/57) and H=(VBW)(R/57), where W is the width of the cell, HBW is the horizontal beamwidth in degrees, R is the range, H is the height of the cell, and VBW is the vertical beamwidth in degrees. The range, R, is the distance from the radar antenna to the reflecting object, i.e., the target. (see, *Communications Standard Dictionary,* $2^{nd}$ ed., Dr. M. Weik, 1989 [Van Nostrand Reinhold Co., New York, N.Y.], found at http://www.its.bldrdoc.gov/fs-1037/dir-029/4335.htm.

Detection of the nano devices will additionally depend on the radar technology employed, such as particular transmitting antenna, receiver antenna, receiver sensitivities, CW radar, pulsed radar, Doppler radar, phased array radar, other forms of synthetic aperture arrays. In what follows reference is made to a particular antenna transmit and receive technology by way of example. Referring to FIG. 1 in conjunction with FIG. 2, one or more antennae 2 are operated as shown in the configuration illustrated to interact with the collection of nano devices labeled generally as 21 within an oil well. In a preferred embodiment, antennae 2 may be as described in U.S. Pat. No. 5,495,259 entitled Compact Parametric Antenna, referred to as (CPA) the subject matter thereof incorporated by reference herein in its entirety and may be utilized to form the array of antennae depicted in FIGS. 2-6.

Figure 9:
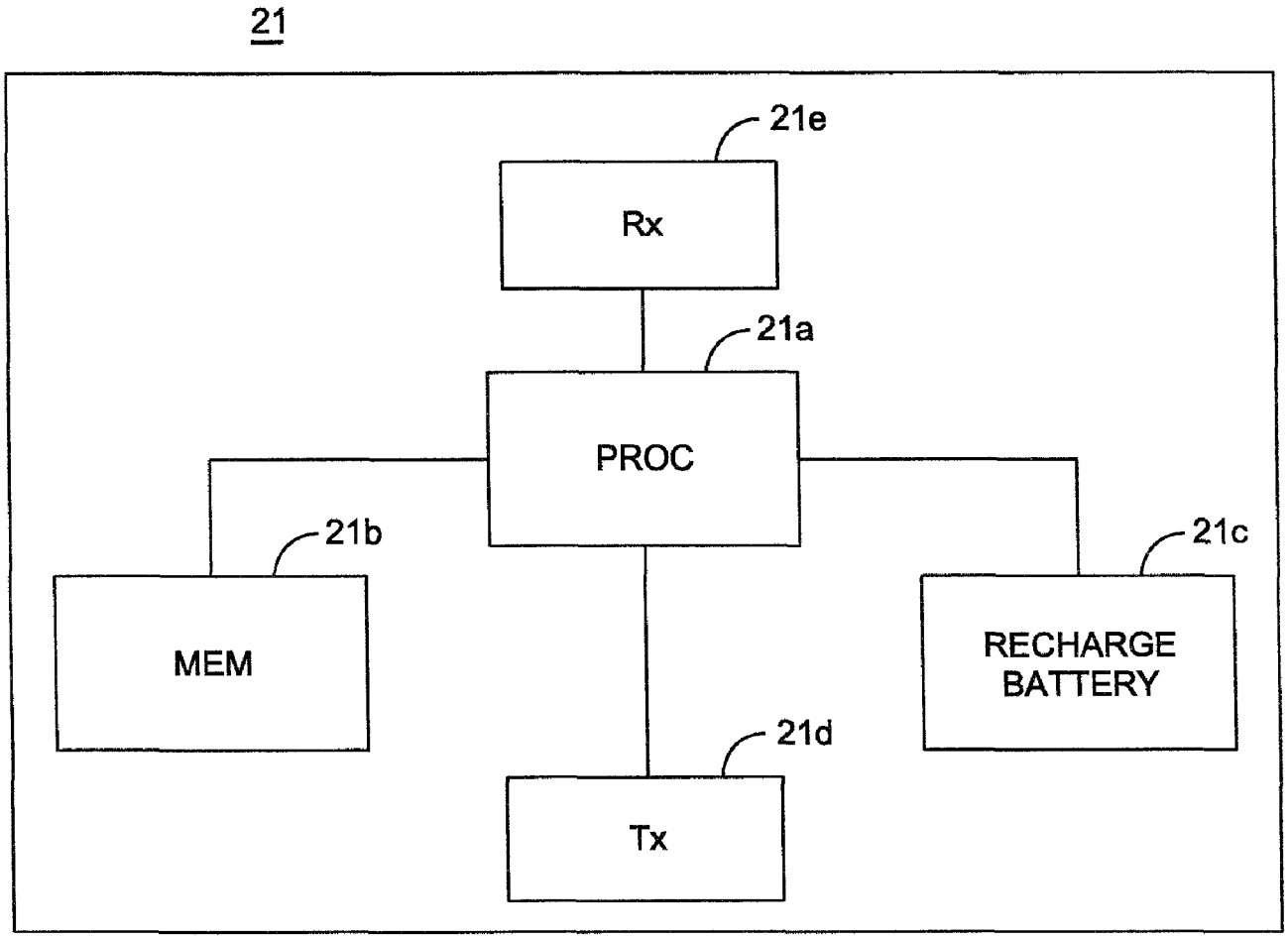
FIG. 9 is a block diagram showing a configuration of a nano device useful in implementing the present invention.

The nano devices 21 may require a rechargeable or remote source of energy, which will aide in imaging the oil well reserves, communicate data related to the reserves, and or aide in the alteration of the viscosity of oil and thus enhance productivity for recoverable oil. Nano devices 21 may be adapted as smart sensors as is understood by one of ordinary skill in the arts and as depicted, by way of example only in FIG. 9. The nano device 21 functionality may include a processor 21*a* (e.g. micorocntroller, ND converter), memory 21*b* and rechargeable battery 21*c* by way of example only, and may be configured to receive signals by means of a receive component 21*c* and transmit signals by means of a transmit component 21*d*, as is understood by one of ordinary skill in the art. With reference to FIG. 9 in connection with the system shown in FIG. 1, for example, the system uses energy transmission to target nano devices for petroleum production for purposes of powering rechargeable power systems (e.g., voltaic cells, capacitors) existing in nano devices 21.

Figure 2:
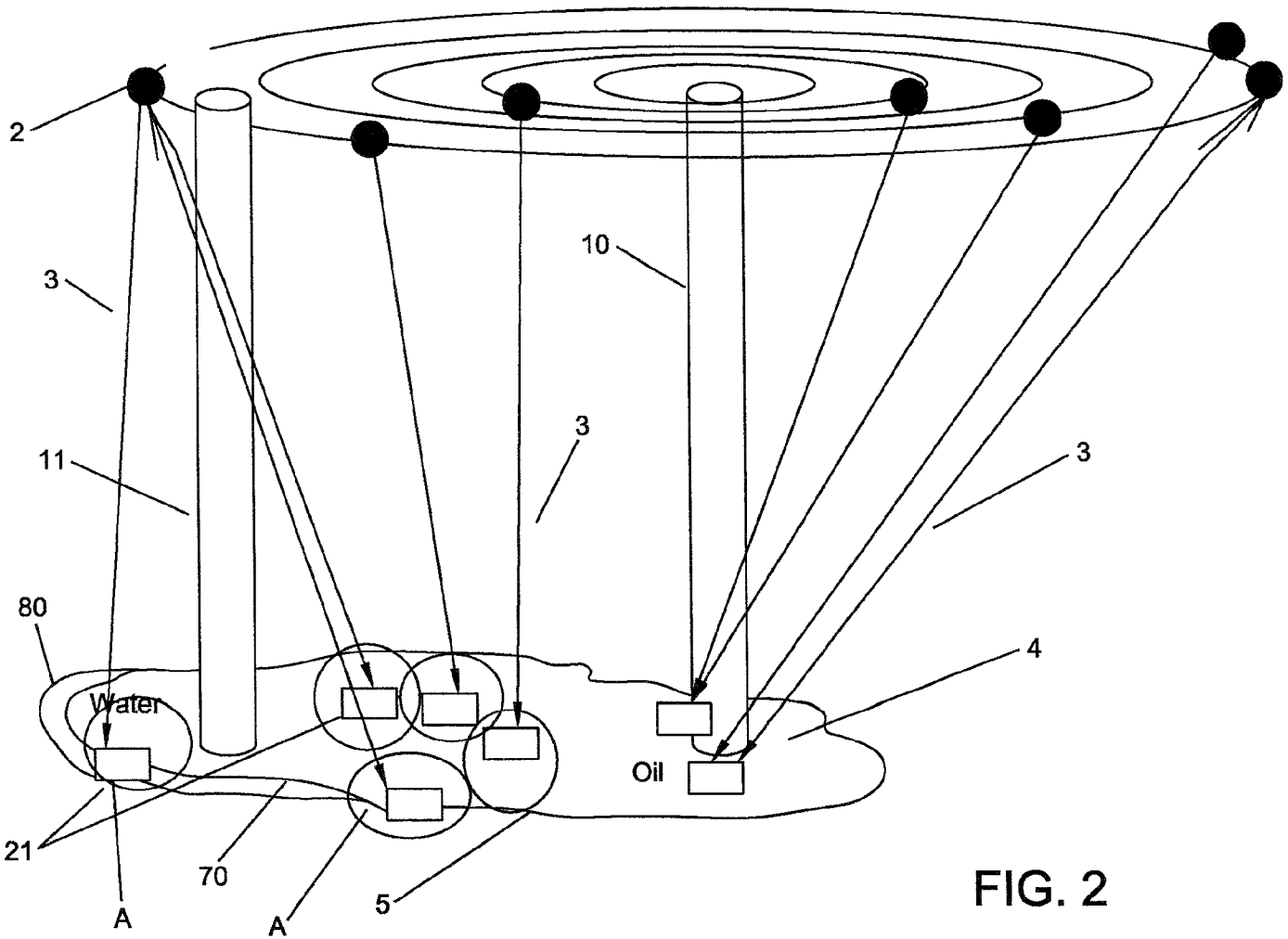
FIG. 2 is an illustration of a system for imparting electromagnetic signals into a reservoir containing oil and nano devices to charge the nano devices, according to an embodiment of the present invention.

In FIG. 2, antennae 2 are positioned and directed to transmit electromagnetic energy in the form of signals 3 immediately in the far field of an electromagnetic field through the strata to irradiate the nano devices 21 within the well zones 70, 80. The antennae 2 are configured so as to provide a directed radiation pattern having in one embodiment a conical profile. By way of example only, the center of each beam is positioned to irradiate nano devices 21 at various locations such as within each area A of the reservoir. The configuration and beam focusing associated with the array of antennae 2 forms a uniform field radiation pattern that covers the zones 70, 80 to thereby irradiate nano devices 21 within its beam width. In a preferred embodiment, the outer 3 dB edge of the intersecting focused energy beams combined cover substantially the entire reservoir zones 70, 80.

Referring again to FIG. 2, in one non-limiting embodiment of the invention, the array of CPA antennae 2 are operated by applying electromagnetic energy in the form of energy signals 3 for a length of time at a frequency (ranging from about 100 Hz to about 100 kHz) consistent with sufficient transmission through the intervening strata at an exemplary irradiated power required to charge one or more power sources within the nano devices 21. In one embodiment, signals of about 10 kilowatts (kW) power irradiate the nano devices 21 at a depth defined by the well zones 70, 80. The energy beams from the transmit antennae 2 are either in the form of a CW transmission or at a pulsed repetition rate, wherein the power, directivity, and/or frequency of the transmitted magnetic energy may be adjusted to provide a desired charging rate to the nano devices 21. In general, the system operates by providing the signal such that the electromagnetic field is focused at the depth of the oil reservoir so as to charge the nano devices 21.

Each transmit antenna 2 according to an embodiment of the present invention transmits with low loss (i.e. no near field loss) through the various strata including soil, water, rock and the like. That is, the CPA antenna design generates EM with no near field effect. The electromagnetic near field is fully formed within the antenna. The antenna is configured as a mobile antenna arranged in a compact housing that is many times smaller than the wavelength that it may transmit at (e.g. on the order of hundreds of times smaller). For example, at an antenna operating frequency of 3 kHz, the wavelength may be 100,000 meters. Typical antenna systems are designed to be one half (i.e. ½) to one sixth (i.e. ⅙) the length of the wavelength. A CPA antenna operating at 3 kHz can be less than one meter (1 m) in length (or height) with an efficiency of greater than 50%. The antenna is also orientation independent to facilitate placement within various configurations. In one configuration, the antenna core is a mixture of active dielectric and magnetic material. The core material can have a combined magnetic permeability and electric permittivity >25,000. Core particle density (on the order of $10^{12}/cm^3$) are free flowing within the internal magnetic field. Active core material is coherently polarized and aligned with very high efficiency, resulting in very little core Joule heating. For an antenna operating in the low kilohertz range (e.g. 5 kHz), the antenna housing may have a height of about 3 ft. The small size of the antenna package advantageously enables multiple antennae to be configured within a relatively small footprint.

Figure 3:
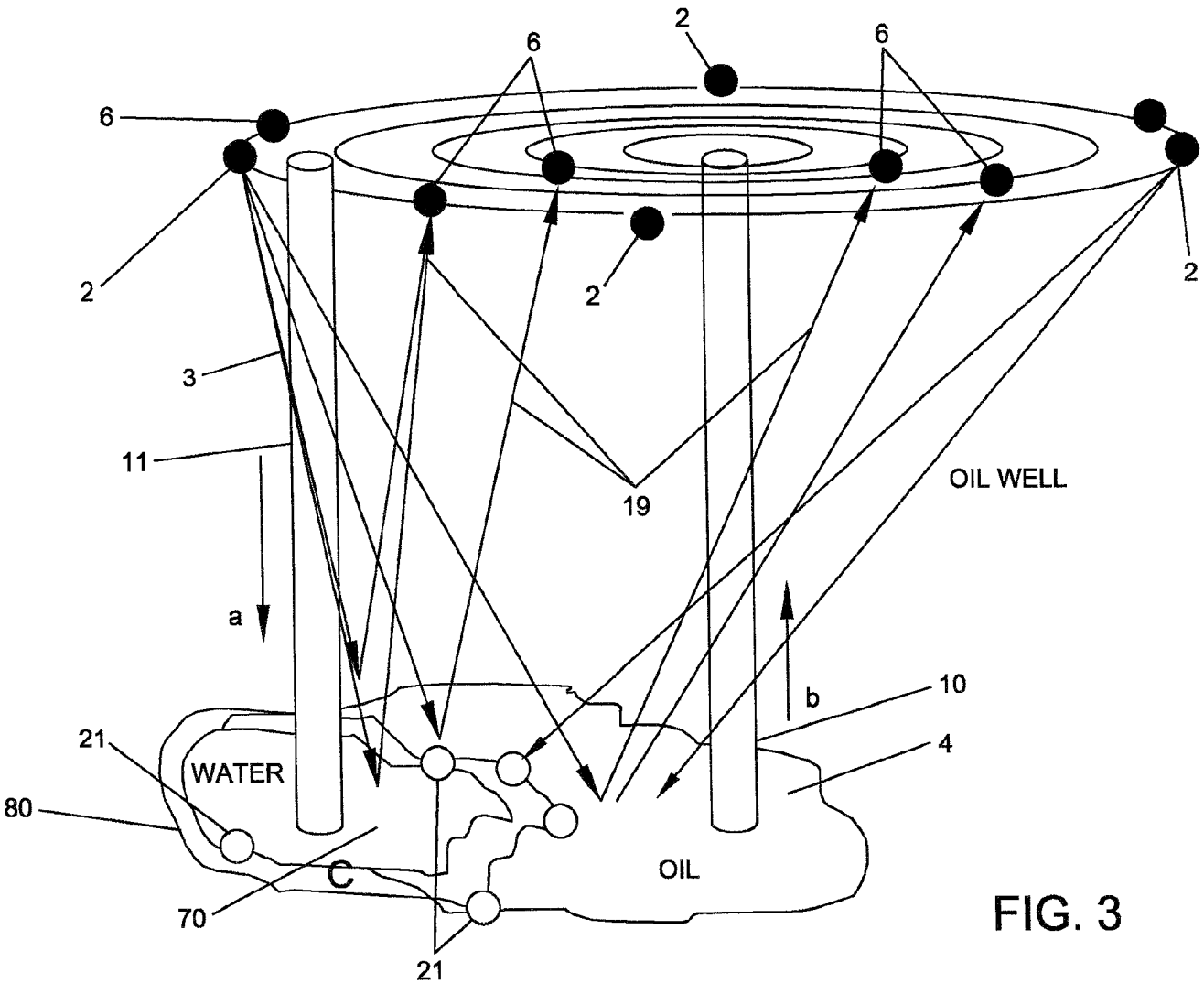
FIG. 3 is an illustration of a system for imparting electromagnetic signals into a reservoir containing oil and nano devices to map an image according to an embodiment of the present invention.

An aspect of the invention herein is further drawn to using energy and communication techniques to target nano devices 21 for petroleum production for purposes of extracting data via communicating with nano sensors for purposes of gathering information (such as mapping data associated with the nano devices 21, mapping the subterranean topology where the well resides, or sensing the physical properties and features of the petroleum environment.) The nano sensors 21 existing as ensembles or colonies situated within an oil production well over time exhibit positional changes and/or changes in the shape or morphology of the colony depending on applied forces (e.g., fluidic currents). The system enables monitoring of the relative movement and morphological changes in the ensemble of the nano devices 21 in the oil and/or water over a given area. These changes are exhibited by the detection of incremental or relative changes of the intensity of the received power or reflections received by receive antennae 6 and reflected off of the ensemble of nano sensors 21. the nano sensors are configured so as to provide distinctly different absorption and/or reflection characteristics than that of the associated oil in which the nano sensors are immersed. The nano sensors may be adapted to be responsive to only specific frequencies such that when an irradiating beam of the selective frequency impinges upon the target zone 70, reflections characteristic of the nano sensors are sensed by the corresponding receiver antennae and processed. In this manner, there is provided selective frequency transmission and reception characteristics associated with the nano sensors, enabling tracking of the movement of these sensors and associated oil within the well zone. FIG. 3 is an illustration of a system for imparting signals and receiving reflections from the signals from a reservoir containing oil and nano devices 21, according to an embodiment of the present invention. The radar system includes by way of example and not limitation an array of four (4) transmit antennae 2 positioned about the production well 10. Although, FIG. 3 shows four (4) antennae, more or less than four (4) antennae may be used in detecting targets via receive antennae 6 and subsequently processing the return signals to image the detected targets. In one embodiment of the invention phased array antennae and associated processing is utilized to irradiate the oil well zones 70, 80. The returns of the phased array are received and processed via beamformers to achieve an image of the nano devices 21 present in the zones 70, 80. The receiver antennae 6 may be positioned on the surface or underground. In this way, the user of the system can ensure that the reflections from the nano sensors provide sufficient received power for the receivers. Phased array systems and imaging techniques are well known by those skilled in the art of imaging phased array antennae radar returns. Mechanisms for scanning sequencing and transmit, receive processing, and the like are analogous to those described in co-pending patent application Ser. No. 12/545,068 filed on Aug. 20, 2009, the subject matter of this co-pending application incorporated by reference herein in its entirety.

Returning to FIG. 3, the transmit antennae 2 are adapted for transmitting in the far field electromagnetic energy focused to irradiate nano devices 21 situated in the well zones 70, 80 within the electromagnetic field. In the present invention, the processing (e.g., for purposes such as mapping the subterranean topology), is performed on the reflected return signal as presented to antennae 6. Note that the antennae 6 may be positioned above ground, embedded in the ground at any depth or follow the various bore holes leading from ground to the reservoir. The antennae 2 direct electromagnetic energy in the form of signals 3 in the far field through the strata to irradiate the nano devices 21 within the well zones 70, 80 without near field interference effects. In one embodiment, the configuration and beam focusing associated with the array of antennae 2 forms an uniform field radiation pattern that covers the zones 70, 80 to thereby irradiate nano devices 21.

As illustrated in FIG. 3 another aspect of the present invention measures and tracks, as well as maps the morphology or the ensembles of nano devices and the movement of the nano devices such as by way of example nano devices 21 within the zones 70, 80. Auxiliary well 11 injects gas or steam into the reservoir for facilitating oil movement toward the area 4. The nano sensors will generally move dependent upon the fluid forces injected into the well 11, the viscosity of the medium and the individual specific gravity of the nano devices 21. Upon repeated electromagnetic irradiation of the zones 70, 80, the movement of the nano devices 21 may be tracked by processing the received antennae 6 return signal 19. The reception of the return signals 19 is accomplished, for example, by positioning a series of antennae receivers (e.g. CPA receivers) either above or below the ground 13 (FIG. 1). Receive antennae 6 operate to receive and send the received signal 19 to a processor (not shown) whereby the signal is tracked as a function of time and correlated in ways dependent upon fluid flow dynamics (e.g., rate of flow, viscosity, eddy currents, nano sensor device specific gravity, etc.) over a given time interval.

Figure 4:
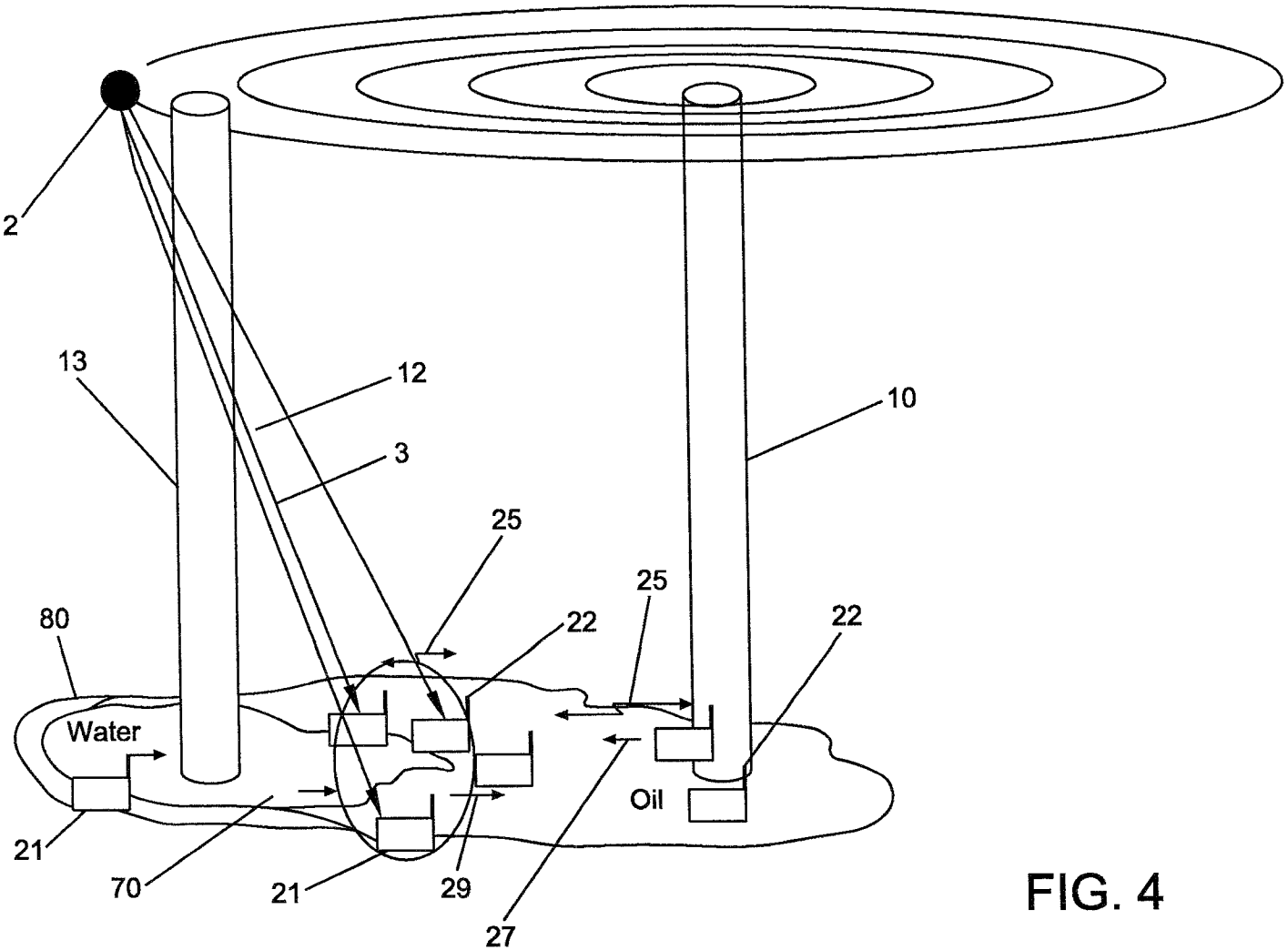
FIG. 4 is an illustration of a system for imparting electromagnetic signals into a reservoir containing oil and nano devices to communicate and/or control the nano devices, according to an embodiment of the present invention.

In accordance with FIG. 4, the invention is further drawn to using energy and communication techniques to communicate with nano devices 21 to effect motion of the sensor. For example, in 2003, the Zettl Group at Lawrence Berkeley Laboratories at the University of California fabricated the smallest-known non-biological nanomotor (Zettl). (see, http://www.imm.org/documents/IMM Roadmap molecular machines.pdf). The device employed a multi-walled carbon nanotube (MWNT), which served as both a bearing for the rotor and as an electrical conductor. Rice University has been developing the Nanocar (and its evolving product line of wheelbarrows and trucks). The motor rotates and pushes a protruding molecular group against a substrate propelling the molecular car forward along an atomically flat surface under 365 nm wavelength light. (see, http://www.physorq.com/news7438.html)

Zettl also announced a single carbon nanotube molecule that serves simultaneously as all the essential components of a radio, i.e., an antenna, a tunable band-pass filter, an amplifier, and a demodulator. Using carrier waves in the commercially relevant 40-400 MHz range and both frequency and amplitude modulation (FM and AM), Zettl was able to demonstrate successful music and voice reception. (see, http://machineslikeus.com/researchers-create-first-fully-functional-nanotube-radio.html). The above combination of features combined with the ability to receive a signal allows control over the movement of nano devices 21 within the oil reservoir.

FIG. 4 illustrates a system for communicating data and imparting control signals via signals 3 to nano devices 21 to communicate information and to control molecular-scale analog and digital circuits according to an embodiment of the present invention. Those of ordinary skill in the art of telemetry are familiar with these techniques. An electromagnetic transmission system including, by way of example, and not limitation one (1) transmit antennae 2 positioned to transmit a signal 3 into the production oil well zones 70, 80. FIG. 4 shows antennae 2 representing one or more antennae for communicating data to and controlling the operation of the nano devices 21. As previously described in connection with FIGS. 1-3, transmit antennae 2 are adapted for transmitting in the far field electromagnetic energy focused to irradiate nano devices 21 in the well zones 70, 80 within an electromagnetic field. In the present invention, the electrical or chemical processing necessary to mobilize the nano sensor is performed within the technology built into the nano devices 21. The antennae 2 directing electromagnetic energy in the form of signals 3 in the far field an electromagnetic field through the strata to irradiate the nano devices 21. Signal 3 in one embodiment includes information, status and control data for controlling the nano devices 21 in the well environment. A means to receive 22 the control data serves to pass on the control data signal to a controller or processor that actuates control (e.g., propels) the nano devices 21. In FIG. 4, the nano sensors may be directed via further signal 3 control (See, FIGS. 7-8) to move in a direction 25, 29 (vice direction 27) having any one of six degrees of freedom. A receive antennae 6 as illustrated in connection with FIG. 3 may further operate to receive and send a received signal to a processor (See, FIGS. 7-8, 710) for further control via control data of the nano devices 21. In this fashion, a closed system of directing control as illustrated and described in connection with FIG. 4 dependent upon the nano devices 21 receiving signal 3 in accordance with the illustration and description in connection with FIG. 3 and FIGS. 7-8, to be further described below.

Figure 5:
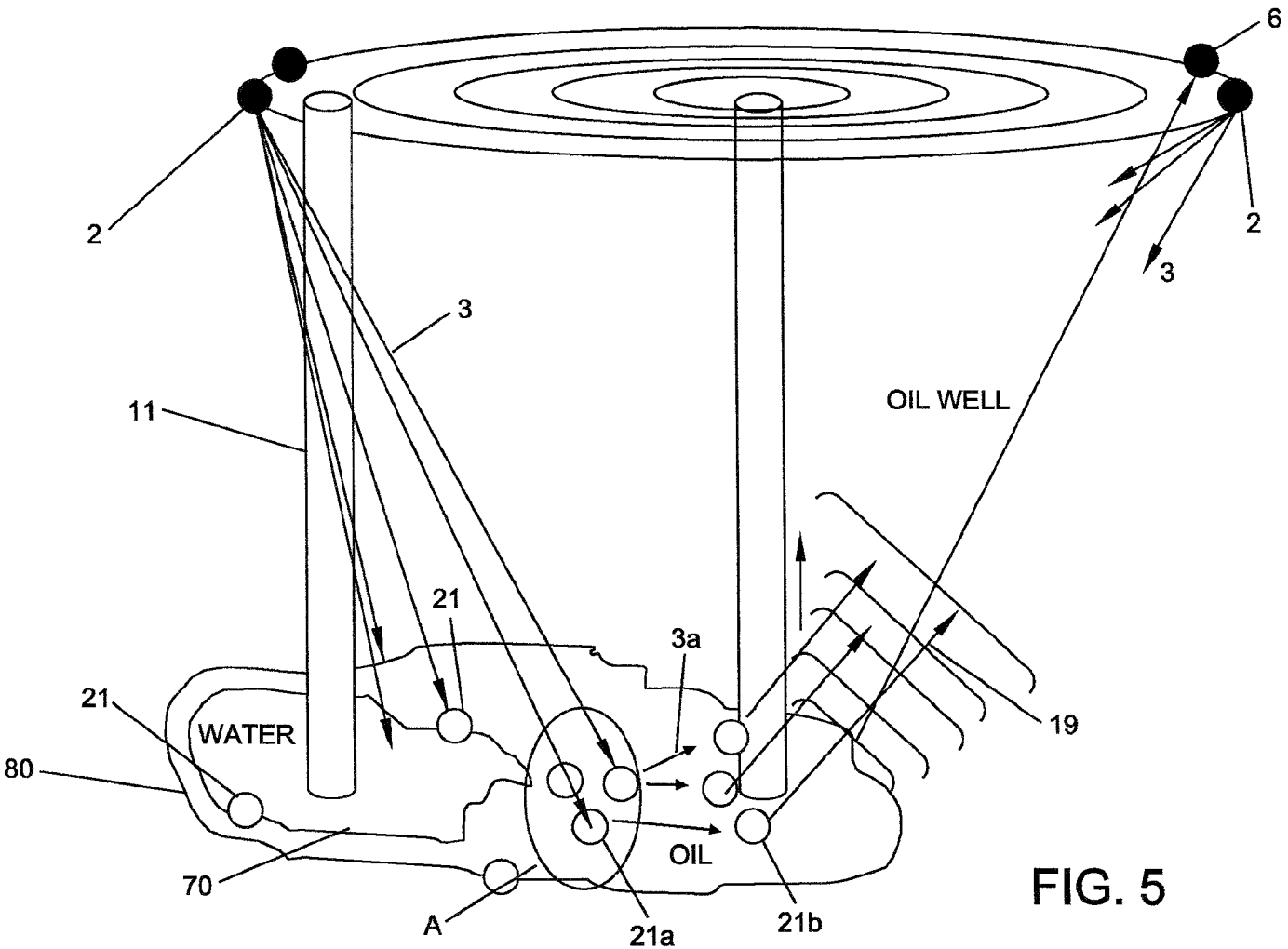
FIG. 5 is an illustration of a system for imparting electromagnetic signals into a reservoir containing oil and nano devices to transmit and receive signals to and from the nano devices, according to an embodiment of the present invention.
Figure 7:
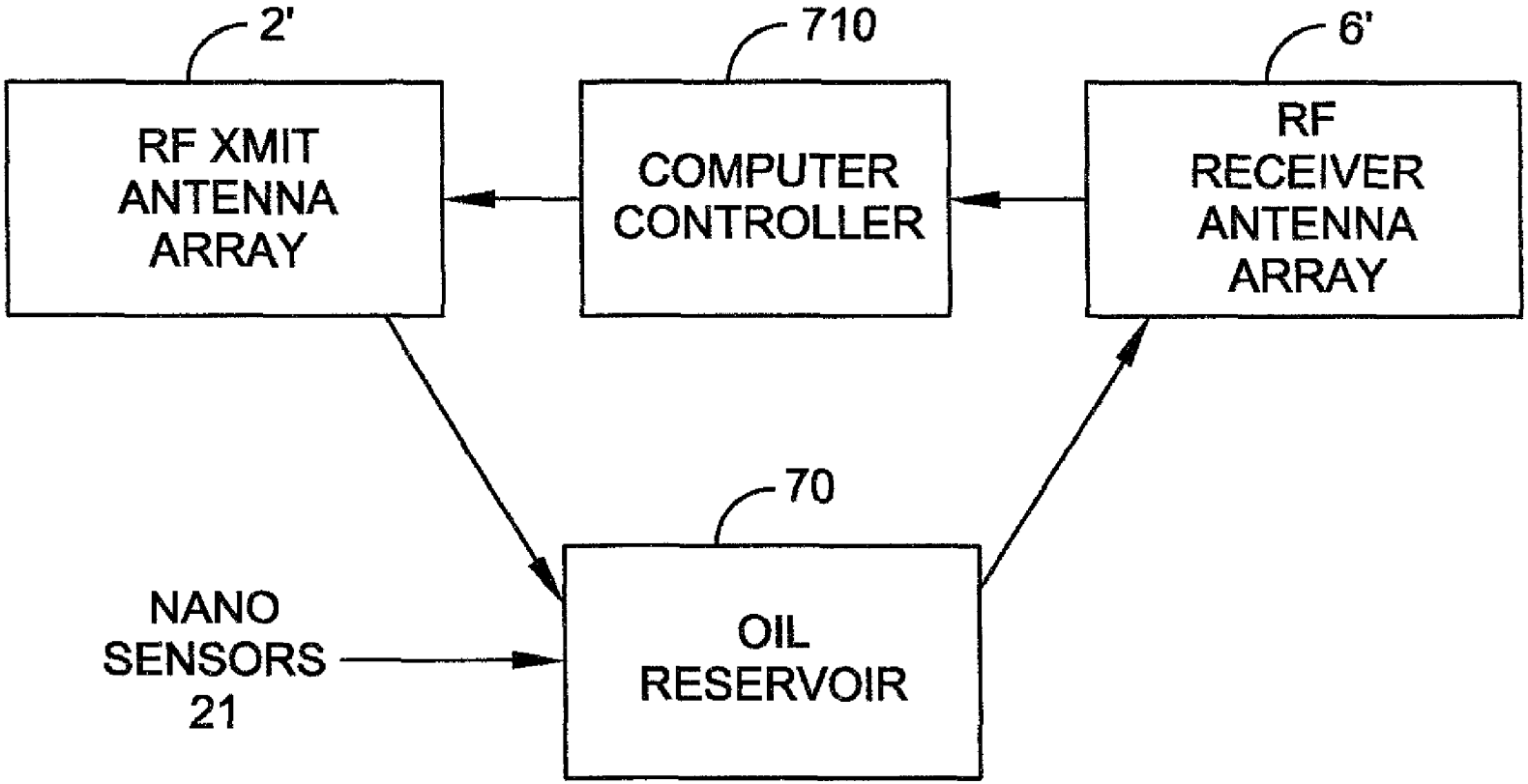
FIG. 7 is a block diagram showing exemplary processing sequences for controlling and mapping nano devices in accordance with embodiments of the present invention.
Figure 8:
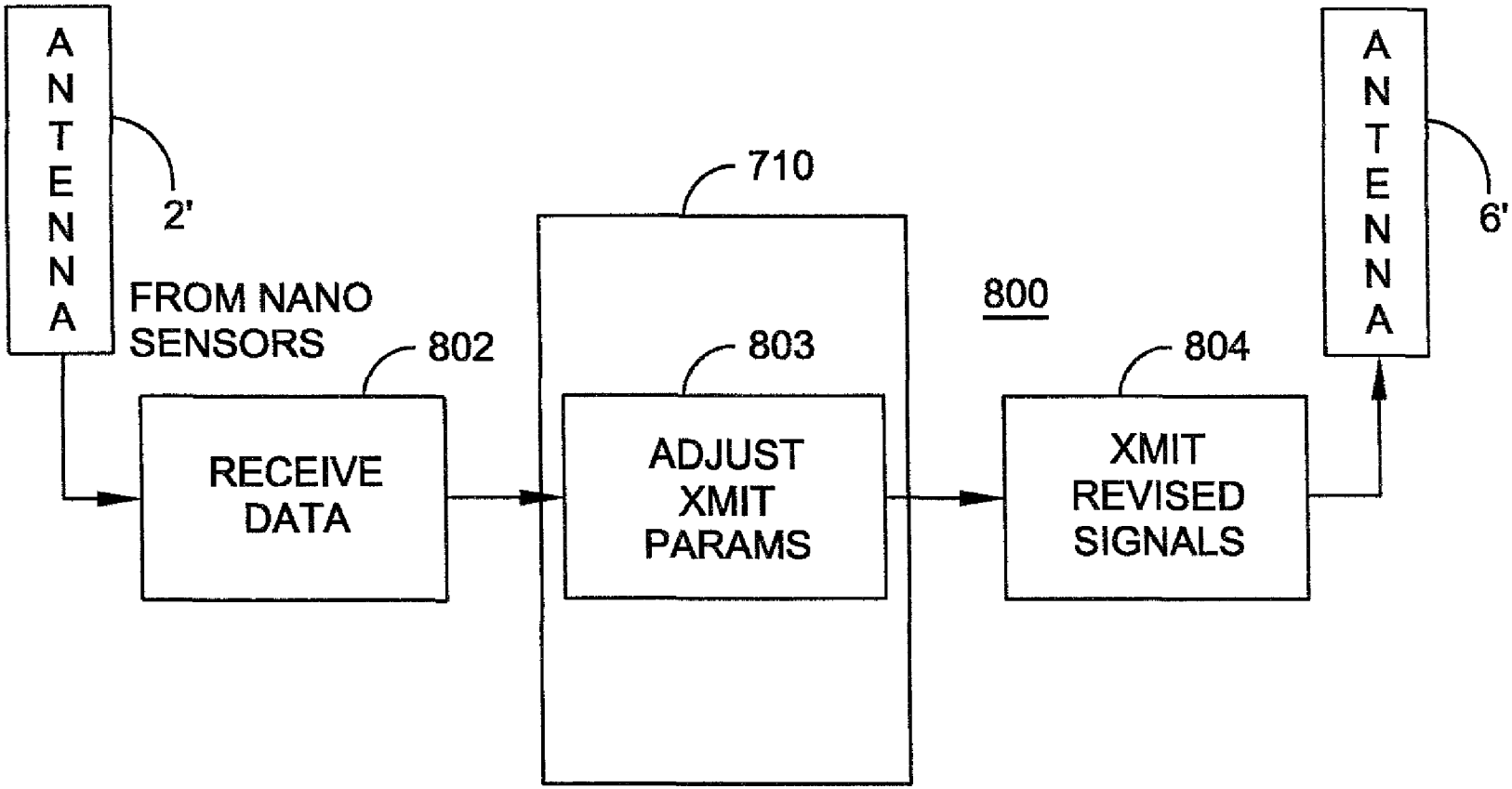
FIG. 8 is a block diagram showing exemplary processing sequences for determining geological mapping via nano devices in accordance with embodiments of the present invention.

In accordance with FIG. 5, and FIGS. 7-8 signal 3 may also represent an interrogating signal to a nano sensor computer memory (FIG. 9), containing information acquired and stored while resident in the zones 70, 80. Alternatively, as illustrated in FIG. 5, nano sensor 21*a*, upon reception of signal 3 signal transmitted from antennae 2, may initiate communication among other nano devices 21*b*. In this manner, the nano devices may interact based on an initial control signal from antennae 2 to perform certain actions (e.g. provide location information, environmental parameter information (temperature), controlled vector motion, and the like). The nano sensor may operate as a molecular dipole antenna that may be modulated to transmit and receive magnetic signals to/from the surface. In another embodiment, nano sensors may in response to reception of a signal 3 or signal 3*a*, send a signal 19 to receiver 6. The information communicated via signal 19 may include information (described above) acquired and stored while the nano sensors are resident in the zones 70, 80. Such information may by way of example but not limitation be used to map the subterranean topology, and/or determine properties of the oil well, the constituents within the well and the efficiencies of the recovery process. As will be appreciated a control signal 3 to nano devices 21 may also be employed to prompt biochemical nano devices 21 to test or sense the environment and communicate physiochemical properties within the oil well via signal 19. Each of these control signals may be constituted by different selective transmit frequencies and/or power levels to activate a function of the nanosensors 21.

Figure 6:
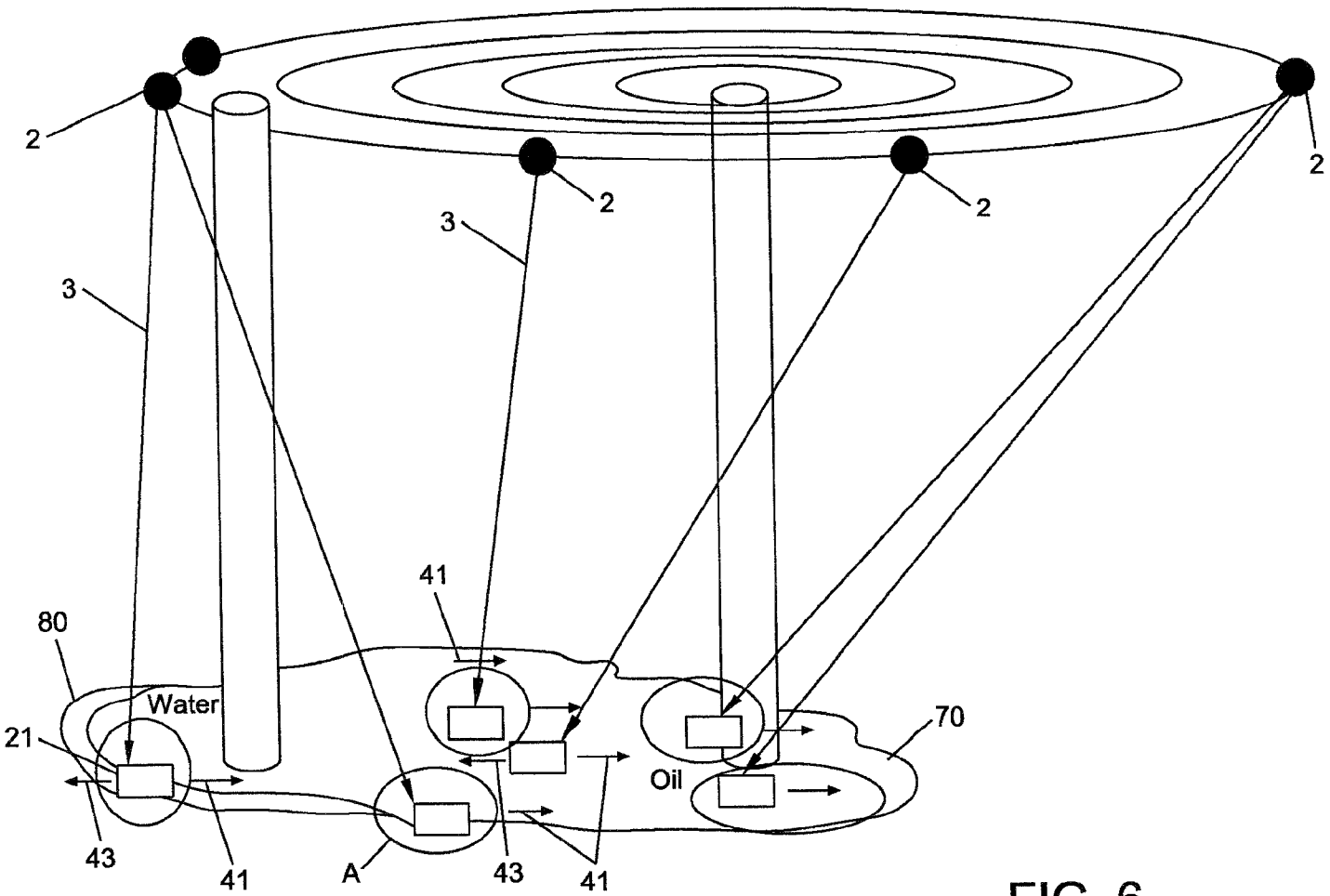
FIG. 6 is an illustration of a system for imparting electromagnetic signals into a reservoir containing oil and nano devices to transmit signals and control the motion of the nano devices, according to an embodiment of the present invention.

FIG. 6 illustrates a system to initiate selective chemical or catalytic processes according to an embodiment of the present invention. A transmission system including, by way of example, and not limitation one or more one transmit antennae 2 positioned to transmit a signal 3 into the production oil well zones 70, 80 controls one or more nano devices 21. As previously described in connection with FIGS. 1-3, transmit antennae 2 are adapted for transmitting in the far field electromagnetic energy focused to irradiate nano sensor 21 in the well zones 70, 80 within an electromagnetic field. In the present invention, the electrical or chemical processing necessary to mobilize the nano sensors is performed within the nano devices 21. Signal 3 includes control data for controlling the nano devices 21 within a zone A to release biochemical agents 41 that serve to enhance a chemical or catalytic process. A means to receive 22 (FIG. 4) the control data serves to pass on the control data signal to a processor (not shown) that actuates a control that e.g., expels a chemical agent such as a catalyst into the oil well zones 70, 80. A receive antennae 6 as illustrated in connection with FIG. 3 may further operate to receive and send a received signal to a processor 710 (FIG. 7-8) for further control via control data of the nano sensor 21. In this fashion a closed system of directing chemical control as illustrated and described in connection with FIG. 4 dependent upon the nano devices 21 receiving signal 3 in accordance with the illustration and description in connection with FIG. 3.

It is further understood with reference to the illustration of FIGS. 3-6 that the antennae 2 may be controlled by means of an arrangement as shown in exemplary fashion by the block diagram of FIGS. 7-8. A controller 710 operates to control the antennae 2 array parameters, including but not limited to frequency, duration, power output, pointing direction, and the like, so as to focus communication signals 3 or energy signals 3 at the appropriate depth and level for interacting with the nano sensor 21. In one embodiment, a feedback mechanism may be employed, for example, based on monitoring the oil output from the production well 10 (FIG. 1), via data received from the nano devices 21 as described in connection with FIG. 3 and FIG. 5 to thereby enable the controller to modify the array parameters according to the well output. For example, if after a predetermined interval, oil output is not increased (or if the rate of change of oil output drops below a predetermined threshold, for example) the controller 710 may send a signal to modify one or more array parameters to cause a change in the signal transmitted to the nano sensors. Such change may be monitored and further adjustments made to the transmission sequence according to the oil output from the well over a predetermined time interval. In this manner, oil located within the reservoir that may have properties, such as too viscous to be harvested, may be altered so as to decrease the viscosity of the crude oil particles and thereby enhance migration of the oil particles to the zone 4 (FIG. 1) for extraction by the production well.

In accordance with an aspect of the present invention, the transmitter antennae 2 and receiver antennae 6 array depicted schematically in FIG. 3-5 is adapted to transmit and receive signals focused to the depth of the reservoir for tracking the relative movement of nano sensors 21 from well zone 70 into the area and the migration of oil from portions of the reservoir to area 4 for extraction by the production well. By way of non-limiting example only, a plurality of CPA antennae 6 having associated receivers are positioned about the surface of the earth proximal to well 10 (FIG. 1) and adapted for receiving signal reflections from the nano sensors 21 in the reservoir at depth d as seen in FIG. 1. A plurality of CPA transmitters (e.g. 2*a*, 2*b*) is positioned about the surface of the oil production well. The well bore casings may be made of an transmissive material so as to not interfere with the pulsed signal transmissions and reflections of the nano devices 21. The overall distance T about which the transmitter/receiver array elements are positioned is about twice the depth d. In one embodiment the transmitters and receivers are positioned at an angle of about 45 degrees and typically several hundred meters from the oil well with the transmitters 2 operative to perform a sequence of transmissions over a range of frequencies (e.g. a series of stepped frequencies) and at appropriate power levels. For example, the pulsed energy signals occur at relatively low carrier frequencies in the range of about 1 Hz to tens of Hz with modulations ranging from 1-20 Hz. By changing the modulation frequencies and/or the receiver frequencies the reflected signals from the nano sensors 21 received by the receiver antennae and processed using a digital signal processor, for example, provide an output indicative of the relative movement and the morphology of constituents of within the reservoir (e.g., water, oil, rock, sand). The reflected signals from the nano devices 21 are received at the array of receivers 6 and relative measurements of the intensities of the reflected signals are obtained and processed to determine a background or threshold signal mapping of the reservoir.

With further reference to FIG. 1 when water is applied to the reservoir via the applicator well 11, the applied water begins to migrate over larger and larger portions of the reservoir. By iteratively performing the transmit/receive sequencing described above and monitoring the output, a relative change in the mapping parameters or characteristics of the nano sensors 21 over time may be seen due to differences in the level of absorption in water relative to that of oil or the reservoir material itself (e.g. rock, sand, and the like at a given location or area). In this manner, the relative differences in the reflected signals provide an indication as to the path that the water is taking and/or the level of encroachment of the water applied via well 11 (FIG. 1) to the reservoir. Such monitoring of received energy signals and determination of relative changes over time caused by the migration of the nano sensors 21 and tracking of such relative changes may be accomplished using conventional signal processing techniques and image mappings and will not be discussed further in detail for the sake of brevity.

In one embodiment, the transmitter/receiver arrangement is arranged to transmit over several different frequencies and/or power levels in accordance with the material properties detected or estimated to be contained within the reservoir (e.g. water, oil, rock, sand) to obtain a common mode error. Estimates may be made as to the expected losses through the strata at different frequencies (for example, estimated losses at 1 kHz, 10 kHz, etc.) with the changes occurring as background changes to a mapping of the nano sensors 21 within the reservoir. Multiple receiver antennae may be adapted in a circular pattern so as to initially image the nano sensors 21 within the reservoir area to obtain a baseline image of the reservoir. In one exemplary form, water is applied and the transmitters operated, the receiver array and signal processing will detect the relative changes to the reservoir mapping due to migration and spatial distribution of the nano sensors 21 so as to enable real time monitoring of the encroaching water. Such mapping and monitoring advantageously allows an operator to determine if the water application is proceeding as expected, or if alternative measures need to be taken.

According to aspects of the present invention, the transmitter/receiver array as discussed above with respect to FIG. 3-6 may be applied to aid in determining an optimal location of a production well or the location of an auxiliary well relative to the production well. For example, with reference to FIGS. 3 and 5 the array of transmitters 2 and antennae 6 may be modified in frequency, power level, duration, stepping functions and the like so as to obtain a geological static picture or image of the nano sensors 21 in an area shown as reservoir zones 70, 80. The reservoir zones 70, 80 may contain various geological formations, including oil deposits, rock formations, and gravel formation between the sand layers. The sequence of transmissions and reflections from the nano devices 21 to the array of antennae 6 allows determination of how, for example, the oil is dispersed within a sub zone of the reservoir, thereby enabling determination of an optimal location and placement of a production well.

FIG. 7 and FIG. 8 illustrate processes for controlling the nano devices 21 and for mapping the morphological features of the ensemble and spatial position of the nano devices 21. In accordance with the block diagram of FIG. 7, a system 700 including a digital control unit comprising a digital signal processor and antennae controller 710 may be used to process the signals and frequencies according to the particular application. By way of example, a two dimensional mapping and imaging of the nano devices 21 can be accomplished by rotating the transmit antennae system 2 and the receiver antennae system 6 assembly at various radii of on the order of hundreds of meters, for example. Lookup tables of reflection/absorption values may be used to assist in the determination and estimation of the content and range of the geological features under test. Further as shown in FIG. 7, controller 710 controls the processing and sequencing of transmit receive data so as to obtain two or three dimensional imaging of the nano sensors 21 within the sub zone by using different frequencies to determine the pockets of nano sensors 21. As illustrated in FIG. 8, based on the return signal distance, the intensity and frequency response of the returned signal, adjustments to the antennae direction may be made. Also based on the return signal distance, the intensity and frequency response of the returned signal determination may be made as to the migration pattern, the morphology of the nano devices 21 and position and motion of the material content (e.g. rock, sand, gravel, water or oil), the magnitude or size of the material, and the relative shape or structure of the material. Frequency hopping and/or other signal processing techniques may be used to obtain a mapping of the nano sensors 21.

In one configuration, the system operates to transmit far field pulses, immediately from the transmit antenna, directly into the earth so that the receiver antenna measure reflected return signals of nano sensors 21 in order to map out optimal locations to drill wells. The receiver antennae can be on the ground or beneath the ground. Using appropriate frequencies (e.g. ranging from 100 Hz to about 100 kHz) and power levels of 10 kw or greater, the strength of the reflected returns provide an indication as to the sub-surface ground composition. For example, using appropriate frequencies and power levels, the strength of the reflected returns from the nano devices 21 will indicate sub-surface fracture corridors. Using multiple frequencies from the same antenna, the ground composition can be inferred by the effective reflective losses. Time gating the reflected responses to correlate with the transmitted pulse sequences allows for a determination as to the material content of the reservoir, including for example, the location of oil deposits relative to fissures or other strata, thereby providing real time information regarding precise locations at which to establish and drill the production and/or auxiliary wells.

According to an aspect of the present invention, the nano sensors may comprise nano particles responsive to an external magnetic field to become aligned and polarized. Transmit antennae operative to transmit immediately in the far field the magnetic signal of sufficient strength to cause the nano particles to become aligned. A subsequent magnetic signal sequence generated from transmit antennae 2 may cause the nano particles to be directed by way of the magnetic field in a particular orientation or direction. In this manner, directed movement of the particles (and hence oil) may be accomplished. The system is further operative by means of imaging the well zone as discussed herein to track the motion through a series of reflections as discussed above from selective sequencing of transmit antennae on the surface to direct the motion of the nano sensors. Another application includes the implementation of nano sensors as proppants to direct the nano sensors in the form of tiny spheres or other objects into fissures, crevices and the like to maintain these crevices and allow oil flow from such fissures or crevices without collapsing.

While the present invention has been described with reference to the disclosed embodiments, it will be appreciated that the scope of the invention is not limited to the disclosed embodiments, and that numerous variations are possible within the scope of the invention.

What is claimed is:

1. A communications method for communicating information to nano sensors located within a select subsurface region, the method comprising:

from multiple positions on or below the terrain surface and separated from the select subsurface region via geological strata, transmitting immediately in the far field electromagnetic energy beam signals of a predetermined frequency, duration, and power that combine to cover a target area of the select sub surface region; and receiving via one or more nano sensors located in an oil reservoir at the select subsurface region said electromagnetic beam signals, wherein the one or more nano sensors are responsive to the received electromagnetic beam signals to activate a function of the nano sensors.

2. The method of claim 1, wherein the nano sensors are responsive to the received electromagnetic beam signals to recharge a battery of the nano sensors using the received electromagnetic energy signals.

3. The method of claim 1, wherein the nano sensors are responsive to the received electromagnetic beam signals to realign themselves according to the magnetic field impinging thereon.

4. The method of claim 1, wherein the nano sensors are responsive to the received electromagnetic beam signals to effect a chemical reaction within the oil reservoir.

5. The method of claim 1, wherein the nano sensors are responsive to the received electromagnetic beam signals for initiating communications with other said nano sensors.

6. The method of claim 1, wherein the nano sensors are responsive to the received electromagnetic beam signals for retrieving information from memory contained within the nano sensors and transmitting said information.

7. The method of claim 1, wherein the nano sensors are responsive to the received electromagnetic beam signals for motion according to the magnetic component of the electromagnetic beam.

8. The method of claim 7, further comprising receiving reflections from the nano sensors in response to the transmitted energy beam signals impinging thereon, the reflections being received at a plurality of receivers for determining characteristics associated with particular media located within the target area.

9. A system for communicating information to nano sensors located within a select subsurface region:

a plurality of transmit antennae located at multiple positions on or below the terrain surface, the antennae adapted to transmit immediately in the far field electromagnetic energy beam signals from multiple positions on or below the terrain surface and separated from the select subsurface region via geological strata, the electromagnetic energy beam signals of a predetermined frequency, duration, and power that combine to cover a target area of the select sub surface region; and a plurality of nano sensors located in an oil reservoir at the select subsurface region and responsive to said electromagnetic beam signals to activate a function of the nano sensors.

10. The system of claim 9, wherein the nano sensors are responsive to the received electromagnetic beam signals to recharge a battery of the nano sensors using the received electromagnetic energy signals.

11. The system of claim 9, wherein the nano sensors are responsive to the received electromagnetic beam signals to realign themselves according to the magnetic field impinging thereon.

12. The system of claim 9, wherein the nano sensors are responsive to the received electromagnetic beam signals to effect a chemical reaction within the oil reservoir.

13. The system of claim 9, wherein the nano sensors are responsive to the received electromagnetic beam signals for initiating communications with other said nano sensors.

14. The system of claim 9, wherein the nano sensors are responsive to the received electromagnetic beam signals for retrieving information from memory contained within the nano sensors and transmitting said information.

15. The system of claim 9, further comprising a plurality of receive antennae adapted to receive reflections from the target area in response to the transmitted energy beam signals impinging thereon and wherein said nano sensors are adapted to reflect or absorb said particular frequencies transmitted by said antennae such that the reflections being characteristic of said nano sensors located within the target area being impinged upon by the transmitted far field electromagnetic energy beam signals.

16. The system of claim 9, wherein each of said transmit antennae comprises a compact parametric antenna having a dielectric, magnetically-active, open circuit mass core, ampere windings around said mass core, said mass core being made of magnetically active material having a capacitive electric permittivity from about 2 to about 80, an initial permeability from about 5 to about 10,000 and a particle size from about 2 to about 100 micrometers; and an electromagnetic source for driving said windings to produce an electromagnetic wavefront.

17. The system of claim 9, wherein each of said nano sensors comprises a molecular dipole antenna.

18. The system of claim 9, wherein each of said nano sensors comprises a proppant.

* * * * *